US008113337B2

(12) United States Patent
Schererz et al.

(10) Patent No.: US 8,113,337 B2
(45) Date of Patent: Feb. 14, 2012

(54) APPARATUS AND METHOD FOR SEPARATING FLAT OBJECTS BY USE OF TWO SEPARATORS AND A LENGTH DETECTOR

(75) Inventors: Holger Schererz, Rehfelde (DE); Michael Schwarzbauer, Constance (DE); Frank Voss, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/869,851

(22) Filed: Aug. 27, 2010

(65) Prior Publication Data

US 2011/0048892 A1 Mar. 3, 2011

(30) Foreign Application Priority Data

Aug. 27, 2009 (DE) ..... 10 2009 039 062

(51) Int. Cl.
*B65G 47/31* (2006.01)

(52) U.S. Cl. ..... 198/460.1; 271/10.03; 271/18; 271/265.04

(58) Field of Classification Search ..... 198/418.7, 198/418.8, 460.1; 271/10.03, 18, 34, 262, 271/263, 121, 265.04
See application file for complete search history.

(56) References Cited

U.S. PATENT DOCUMENTS 3,599,967 A 8/1971 Rapparlie et al.
4,733,226 A 3/1988 Kasuya et al.
5,004,094 A * 4/1991 Brandt ..... 198/460.1
5,597,154 A * 1/1997 Yamashita ..... 271/10.05
5,624,020 A * 4/1997 Mokler et al. ..... 198/460.1
5,924,686 A * 7/1999 Jacobson et al. ..... 271/3.17
5,996,993 A * 12/1999 Arikawa et al. ..... 271/258.01
6,135,441 A 10/2000 Belec et al.
6,328,300 B1 12/2001 Stefan et al.
6,435,498 B1 8/2002 Stefan et al.
6,471,044 B1 * 10/2002 Isaacs et al. ..... 198/460.1
6,536,756 B2 3/2003 Stefan et al.
6,550,764 B2 4/2003 Wilson et al.
6,817,610 B2 11/2004 Rompe
7,108,258 B2 9/2006 Groegor et al.
7,270,326 B2 9/2007 Mitsuya et al.
7,293,769 B2 * 11/2007 Asari et al. ..... 271/258.01
7,537,207 B2 5/2009 Kutzer et al.
7,537,212 B2 5/2009 Mitsuya et al.
(Continued)

FOREIGN PATENT DOCUMENTS

DE 1 817 101 7/1970
(Continued)

*Primary Examiner* — James R Bidwell
(74) *Attorney, Agent, or Firm* — Laurence A. Greenberg; Werner H. Stemer; Ralph E. Locher

(57) ABSTRACT

An apparatus and a method separate flat objects, including flat mail items. The apparatus has a first and a second separator. Each separator extends a plurality of overlapping objects in a direction parallel to the object planes. The second separator has a transport element and a retaining element. The second separator can be operated optionally in a separating mode, in which it is capable of separating objects, and a transport mode. An overlap detection device checks whether an item which is transported by the second separator contains a single object or a plurality of overlapping objects. The overlap detection device measures the respective length of the transported item at at least two instants. If the length changes, the item contains a plurality of overlapping objects. If a plurality of objects has been detected, the second separator is switched over into the separating mode and it separates the objects.

11 Claims, 4 Drawing Sheets

U.S. PATENT DOCUMENTS

| | | | |
|---|---|---|---|
| 2004/0195760 | A1 | 10/2004 | Zimmermann et al. |
| 2004/0245706 | A1 | 12/2004 | Mitsuya et al. |
| 2006/0082048 | A1 | 4/2006 | Mitsuya et al. |
| 2006/0186594 | A1 | 8/2006 | Mitsuya et al. |
| 2007/0085259 | A1 | 4/2007 | Grogor et al. |
| 2008/0211168 | A1 | 9/2008 | Kutzer et al. |
| 2009/0189332 | A1 | 7/2009 | Schwarzbauer et al. |

FOREIGN PATENT DOCUMENTS

| | | | |
|---|---|---|---|
| DE | 19610953 | A1 | 10/1996 |
| DE | 19608939 | A1 | 9/1997 |
| DE | 101 39 231 | C1 | 3/2003 |
| DE | 101 42 331 | C1 | 3/2003 |
| DE | 103 50 352 | B3 | 1/2005 |
| DE | 103 50 623 | B3 | 4/2005 |
| DE | 10 2004 037 422 | B3 | 3/2006 |
| DE | 10 2007 007 813 | B3 | 1/2008 |
| EP | 0926085 | A1 | 6/1999 |
| EP | 1 090 862 | A2 | 4/2004 |
| EP | 1 472 165 | B1 | 11/2004 |
| EP | 1 614 645 | B1 | 1/2006 |
| EP | 1749771 | A1 | 2/2007 |

* cited by examiner

APPARATUS AND METHOD FOR SEPARATING FLAT OBJECTS BY USE OF TWO SEPARATORS AND A LENGTH DETECTOR

CROSS-REFERENCE TO RELATED APPLICATION

This application claims the priority, under 35 U.S.C. §119, of German application DE 10 2009 039 062.6, filed Aug. 27, 2009; the prior application is herewith incorporated by reference in its entirety.

BACKGROUND OF THE INVENTION

Field of the Invention

The invention relates to an apparatus and a method for separating flat objects, in particular flat mail items.

In order that a sorting system can process flat mail items or a photocopier can process sheets or an ATM can process banknotes, it is required to separate these flat objects. The objects are fed to a separating device ("singulator"), and a stream of objects which are separated and are spaced apart from one another leaves the separating device.

German patent DE 10 350 623 B3, corresponding to U.S. Pat. No. 7,537,207, describes an apparatus for separating flat objects. The flat objects (they are mail items in DE 10 350 623 B3) are transported standing upright and in a stacked position onto a pair of draw-off rockers and are drawn off laterally by an under floor belt in interaction with the draw-off rockers. The mail items are transported via a transport path which is delimited on one side by two endless conveyor belts 13, 14 which are connected in series and on the other side by a continuous retaining element 19. The endless conveyor belt 14 which lies downstream pulls a mail item forward, vacuum increasing the driving action. Two transfer rollers 15 drive the mail item further. A light barrier line measures whether a gap has occurred between two mail items which follow one another and are transported by the endless conveyor belt 14.

German patent DE 10 350 352 B3, corresponding to U.S. patent publication No. 20070085259, describes an apparatus having a plurality of separating sections and an under floor conveyor belt. The transport speed of one separating section is higher than the transport speed of a separating section which is arranged in front.

German patent DE 10 2007 007 813 B3, corresponding to U.S. patent publication No. 2008211168, describes a separating apparatus having a plurality of separating stages. At least one separating stage is operated in a start/stop mode.

In order to improve the separating performance, it is proposed in German Utility Model DE 10 139 231 C1 that a transport element operates with vacuum. A suction apparatus generates this vacuum by sucking in air through an endless conveyor belt of the transport element.

U.S. Pat. No. 7,270,326 B2 describes an arrangement with a draw-off roller ("take-out roller 3"), a first separator ("first separation unit 13"), a second separator ("second separation unit 14") and a pair of transport rollers ("pull-out unit 15"). A first sensor 34 measures when a flat object has left the first separator 13. A second sensor 35 measures when a flat object has left the second separator 14. After a flat object has left the first separator 13, the drive motor for the draw-off roller 3 is slowed down temporarily.

Published, European patent EP 1090862 A1, corresponding to U.S. Pat. Nos. 6,536,756, 6,435,498, and 6,328,300, describes an apparatus and a method for separating, transporting and orienting flat mail items. A feed device ("input feed structure 17") having an endless conveyor belt 18 draws upright mail items from a stack 11, see FIG. 1. A first separator ("first document singulating apparatus 23") separates mail items which overlap partially. The first separator 23 has a transport element and a retaining element in the opposite direction, see FIG. 2. An advancing unit ("take away unit 25") having two advancing rollers ("drive roller 29, idler roller 27") is attached downstream of the first separator 23. The mail items run through the first separator and subsequently the advancing unit 25 and then reach an aligning apparatus ("aligner station 31") which has a free-running section in the form of a U-shaped transport channel with two rigid side walls 33, 35. While a mail item is being transported along the aligning apparatus 31, the mail item passes an arrangement having a plurality of sensors 105. Each sensor 105 is, for example, a light barrier which is interrupted by a mail item in the aligning apparatus 31. The aligning apparatus 31 is adjoined by a second separator ("second document singulating apparatus 39") which likewise has a transport element and a retaining element. The second separator is followed by a second advancing device 41 having two advancing rollers 27, 29.

In one refinement of Published, European patent EP 1090862 A2 (FIG. 6), a "singulator sensor 105c" is situated at the level of the second separator 39, and a "take away sensor 105d" is situated at the level of the second advancing unit 41. The signals from said light barriers 105c, 105d are used to stop or restart a feeding conveyor belt 42a in the aligning apparatus 31.

U.S. Pat. No. 6,550,764 B2 also describes an apparatus having two separators which are connected in series, an aligning apparatus and a plurality of light barriers 201 to 231. The light barriers 201 to 231 are interrupted by a mail item. In start/stop operation, the first separator is operated as a function of light barrier signals.

German patent DE 10 2004 037422 B3, corresponding to U.S. patent publication No. 20090189332, also describes an apparatus of this type having a plurality of separators.

Published, non-prosecuted German patent application DE 1817101 A, corresponding to U.S. Pat. No. 3,599,967, describes a device for separating flat mail items. The device has a first separator A and a second separator B. Both separators A, B in each case contain a suction belt 4 and 14 which is guided around in each case a plurality of rollers. Suction openings, through which air is sucked in, are made in the suction belts 4, 14. As a result, the rotating suction belts 4, 14 drive an upright mail item with them and draw it off from a stack of upright mail items. The suction belts 4, 14 are arranged in such a way that a mail item is transported through between the two suction belts 4, 14. A stop wall 9 is situated opposite the suction belt 4, and a stop wall 19 is situated opposite the suction belt 14. The stop walls 9, 19 retain a second mail item and prevent a plurality of mail items being drawn off at once. The two suction belts and the two stop walls 9, 19 are arranged in such a way that, as viewed in the transport direction of the mail items, the first suction belt is situated to the left of the transported mail items and the second suction belt 14 is situated to the right. Correspondingly, the first (as viewed in the transport direction) stop wall 9 is situated to the right of the mail items and the second stop wall 19 is situated to the left of the mail items.

European patent EP 1 614 645 B1, corresponding to U.S. Pat. No. 7,537,212, describes an arrangement having a draw-off roller ("feed-out roller 8"), a first separator ("separation unit SP1"), a second separator ("separation unit SP2") and two pairs of transport rollers which in each case lie opposite one another ("drawing roller 29" and "pinch roller 32" and "conveying roller 34" and "second pinch roller 39"). The arrangement belongs to a photocopier or printer and separates paper sheets of the same size. An overlap detection device ("overlapping detector 40, 41") detects a double draw-off, that is to say a plurality of sheets being drawn off at once. This brings about a situation where the transport rollers 29, 32 which are arranged upstream in the transport direction are stopped and the transport rollers 34, 39 which are arranged downstream pull out the front most object.

In order that the overlap detection device of EP 1 614 645 B1 is capable of detecting overlaps, the objects all have to have the same length. If an item is longer than this setpoint length, it contains a plurality of objects.

German patent DE 10 142 331 C1, corresponding to U.S. patent publication No. 20040195760, describes an apparatus which transports flat mail items in an upright state. Two endless conveyor belts temporarily grip a flat item. The endless conveyor belts are guided around vertical rollers and rotate at different speeds. The length of the item is measured once before this transport by the endless conveyor belts and once after this transport. If these two lengths differ, the item contains a plurality of overlapping mail items.

In European patent EP 1 472 165 B1, corresponding to U.S. Pat. No. 6,817,610, images of mail items are generated. It is determined by evaluation of the images whether an image shows the contour of an individual mail item or the contour of an item which contains a plurality of overlapping mail items.

SUMMARY OF THE INVENTION

It is accordingly an object of the invention to provide an apparatus and a method for separating flat objects by use of two separators and a length detector which overcome the above-mentioned disadvantages of the prior art methods and devices of this general type, which can be used for objects of different lengths and lead to an increased throughput through the second separator.

The apparatus according to the solution has a first separator, a second separator, an overlap detection device and a control device.

The second separator has a transport element, a retaining element and a drive for the transport element.

Each separator is configured for extending a plurality of flat objects, which overlap at least partially, in in each case one direction parallel to the object planes and in an extending plane and for separating them as a result.

The two separators are connected in series. The apparatus is configured for transporting an object from the first separator to the second separator.

Furthermore, the apparatus is configured for transporting the objects to be separated through between the transport element and the retaining element of the second separator. Here, each object covers a path between the transport element and the retaining element of the second separator. This path is longer than the dimension of the longest object as viewed in the transport direction, in which the objects are transported through between the transport element and the retaining element of the second separator.

The overlap detection device is configured for measuring, at at least two instants, the respective length of an item which is transported by the second separator, and, when at least two lengths which are measured for the same item differ from one another, deciding automatically that the item contains a plurality of overlapping objects.

The control device is configured for switching over the second separator into a separating mode, in which the second separator separates overlapping objects, when the overlap detection device has detected that an item being transported contains a plurality of overlapping objects.

Moreover, the second separator can be operated in a transport mode, in which the second separator transports objects.

As a result of the fact that two individual separators are connected behind one another, the apparatus according to the solution achieves a lower fault quota and thus a higher quota of correctly separated objects. Two overlapping objects which the first separator is not capable of separating are separated by the following second separator. The second separator can be switched over between a transport mode and a separating mode. The second separator is operated in the separating mode only when this is required, that is to say when it has been determined that the first separator has not separated two overlapping objects. Otherwise, the second separator is operated in the transport mode and, in the transport mode, achieves a higher throughput of objects than in the separating mode.

In the transport mode, the second separator is not capable of separating any objects, but rather transports objects to a following processing device. In the separating mode, the second separator operates in an operating type which is optimized for separating. In the transport mode, the second separator operates with a higher throughput and operates in an operating type which is optimized for transporting.

The second separator receives objects from the first separator. This refinement avoids the necessity of providing a dedicated transport path between the two separators. On a dedicated transport path of this type between the two separators, overlapping objects which the first separator could not separate would have to be transported in an overlapping manner as far as the second separator.

The two separators are preferably spaced apart from one another, as viewed in the transport direction. However, the spacing is so small that every object to be separated which runs through the apparatus with the two separators is held and gripped at every instant by the first separator or by the second separator or by both separators. This refinement makes it possible to grip every object at every time, even if the first separator is stopped because the second separator is currently eliminating a double draw-off. Furthermore, it can be established for every instant where which object is situated.

The apparatus according to the solution spares the necessity of defining a setpoint length for an object and comparing the actual length of an item (that is, the dimension of the object in the transport direction) with the setpoint length in order to detect a double draw-off. A setpoint length of this type can be defined in a photocopier or printer, but not, for example, in a sorting system for mail items because mail items can have different lengths. This advantage of the length independence is achieved by the fact that the transport element and the retaining element of the second separator extend two overlapping objects and the change in length which is brought about as a result is measured.

The flat objects preferably run through the two separators in an upright manner and are transported through in an upright manner between the transport element and the retaining element. The object plane of each object is therefore perpendicular. This refinement leads to dirt particles and abraded particles falling downward from the transport element past the objects and not falling onto the objects.

According to the solution, the path which an object covers during the transport between the transport element and the retaining element of the second separator, as viewed in the transport direction, is longer than the longest object. The length of the path can be fixed by a corresponding configuration of the second separator. The second separator is preferably configured in such a way that this path is at least 20% longer than the length of the longest object.

The transport element and/or the retaining element preferably bear/bears flatly against the objects to be separated. This refinement brings about improved separation, in particular in the case of relatively large objects, than a separation by individual rollers which bear only in a punctiform manner against an object to be separated.

The transport element of the first separator is preferably situated on another side of that transport path, via which the objects are transported, as the transport element of the second separator. This refinement brings about a further improved separating rate, in particular in the case where two objects overlap partially before reaching the first separator, and the following object is hooked in the leading object and the objects run through the first separator in this way, the following object faces the transport element of the first separator, and the leading object faces the retaining element of the first separator.

In this constellation, the second separator is capable of separating the objects, by its transport element separating the leading object and its retaining element retaining the following object. The first separator is not capable of this.

On their path from the first to the second separator, both objects preferably run through a curved section which is preferably of S-shaped configuration. If two overlapping objects run through this curved region, their front edges are already gripped by the downstream second separator and their rear edges are still gripped by the upstream first separator. As a result, the spacings between the front edges and the rear edges can change, and a spacing and/or an offset occur/occurs between the two objects. This allows the objects to be separated more easily by the second separator.

This refinement is brought about by each separator extending objects in in each case one extending plane. These extending planes are at a spacing from one another, that is to say the two separators are offset laterally from one another. The two extending planes can lie parallel to one another or abut one another in a straight line at an acute angle.

The objects preferably bear flatly against the transport element and against the retaining element of each separator. As a result, an improved separating action is achieved than when the objects are extended only by rollers. This is because, when rollers are spherical, the rollers bear only in a punctiform manner against the objects to be separated. A roller in the form of an ideal cylinder bears against an object in a straight section.

The second separator preferably additionally has an advancing element which is arranged downstream of the transport element and retaining element. The advancing element is capable of temporarily gripping and advancing an item. When the item contains a plurality of objects and the advancing element has gripped the item, the transport element of the second separator is preferably stopped. The second separator is then situated in the separating mode. As soon as the advancing element has completely advanced the first object of the item, with the result that the object is gripped neither by the transport element nor by the retaining element of the second separator, the second separator is switched over into the transport mode again, which contains the step of the drive again moving the transport element of the second separator.

The transport mode and the separating mode therefore preferably differ in that, in the separating mode, the transport element of the second separator advances an object only as far as the advancing element and then stops it, while the transport element is driven continuously in the transport mode. In the separating mode, the transport element of the second separator is therefore preferably operated in a start/stop mode, and in contrast is driven continuously in the transport mode.

Other features which are considered as characteristic for the invention are set forth in the appended claims.

Although the invention is illustrated and described herein as embodied in an apparatus and a method for separating flat objects by use of two separators and a length detector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
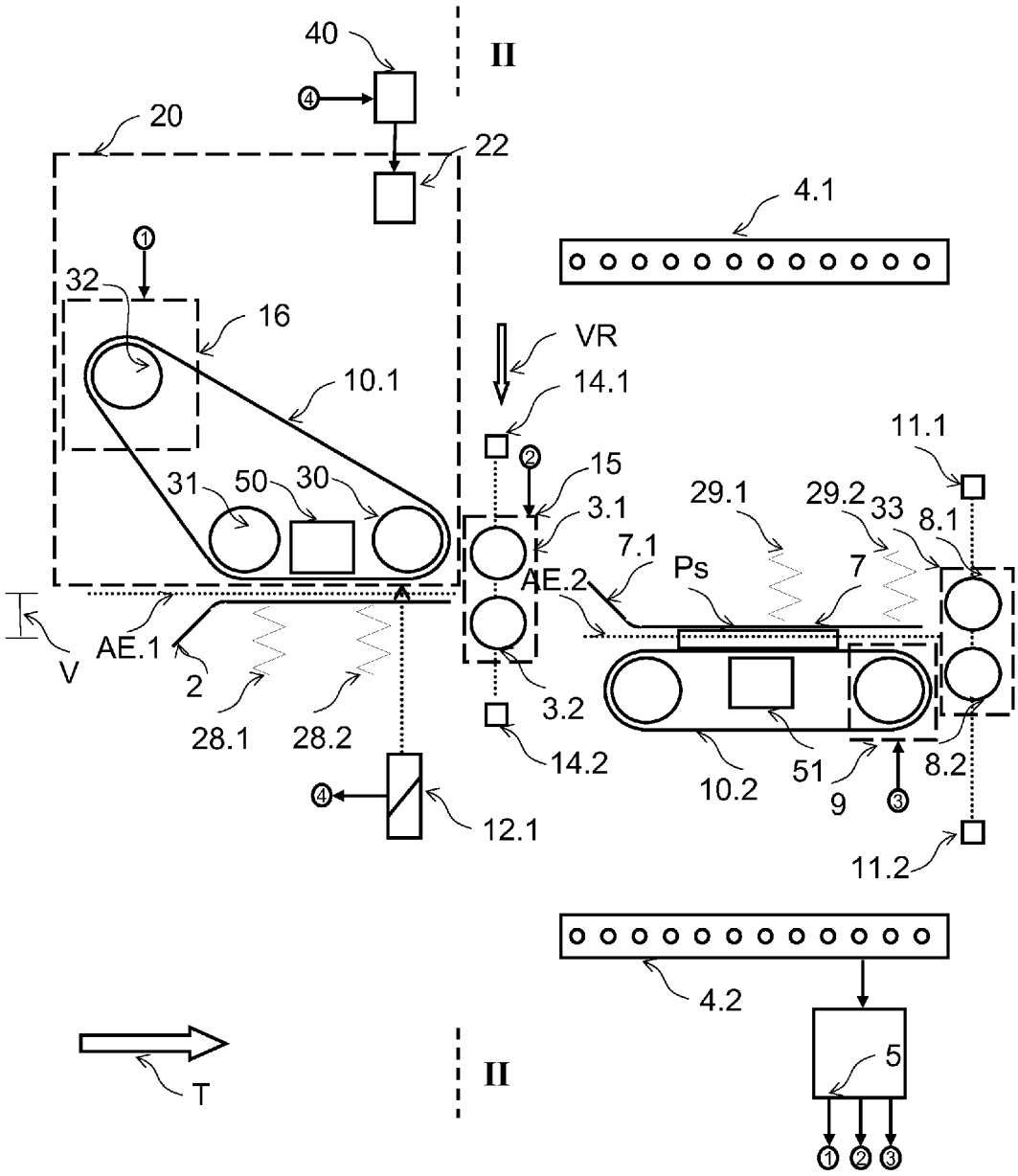
FIG. 1 is a diagrammatic, plan view of an exemplary embodiment of an apparatus according to the invention.

In the exemplary embodiment, the apparatus according to the solution is used to separate flat mail items. Each mail item extends in an object plane. The mail items are transported to the apparatus in a random arrangement.

The mail items are processed by a sorting system with the aim of sorting the mail items in dependence on their respective delivery address. For this purpose, it is necessary to decipher the delivery address of each mail item and to eject the mail item as a function of the delivery address into a sorting terminal of the sorting system. The apparatus according to the solution of the exemplary embodiment is used to separate the mail items in such a way that the mail items can be aligned and oriented afterward, the respective delivery address can subsequently be deciphered and the mail items can be ejected correctly.

The apparatus has two separators which are connected in series. Each separator in each case contains a transport element (driving element), a drive for the transport element, a retaining element, an advancing element and a drive for the advancing element.

The same motor can drive the drives of both transport elements and of both advancing elements. However, the transport element and the advancing element of each separator preferably have in each case a dedicated drive, in order that each separator can be actuated separately and can transport or stop mail items separately.

The mail items are transported through between the transport element and the retaining element of the first separator, are then transported by the advancing element of the first separator, are subsequently transported through between the transport element and the retaining element of the second separator, and finally are transported by the advancing element of the second separator.

During the transport, both the transport element and the retaining element of each separator bear flatly against the mail item, that is to say over the entire length of the mail item or a considerable part of the mail item length. This achieves improved separation than when only two rollers are in contact.

Both each transport element and each retaining element have a nonslip surface, with the result that in each case a sufficiently great coefficient of friction occurs between a mail item and the transport element and between the mail item and the retaining element, to be precise both for the static friction and for the sliding friction. The term "coefficient of friction" is defined, for example, in Dubbel, Taschenbuch für den Maschinenbau [Pocket book for mechanical engineering], 18th edition, section B15. The frictional force is equal to the product of transverse force and coefficient of friction.

The coefficient of friction between a transport element and a mail item is greater than the coefficient of friction between a retaining element and the mail item. The coefficient of friction between the retaining element and the mail item is greater than the coefficient of friction between two mail items which adhere to one another.

In the exemplary embodiment, each transport element contains a plurality of endless conveyor belts which lie above one another, are guided around at least two rollers and are called "driving conveyor belts" in the following text. Each of the rollers is mounted rotatably on a perpendicular shaft or a perpendicular axle. Precisely one roller, about which a driving conveyor belt of a transport element is guided, is preferably driven, and the other rollers are configured as running rollers. In the exemplary embodiment, all the driving conveyor belts of a transport element are guided around the same three rollers. A slot occurs between in each case two driving conveyor belts which lie above one another.

In the exemplary embodiment, the retaining element contains a plurality of stationary components. Each of the components contains a straight element. The straight element bears flatly against a mail item. The stationary components of a retaining element are arranged above one another. In order to hold the components in position, the stationary components which lie above one another rest on a rake of a belt support. The belt support is mounted in a stationary manner, for example on a separator base plate. Furthermore, each stationary component contains a bent deflection component.

In another refinement, each retaining element also in each case contains at least one endless conveyor belt which is called a "retaining conveyor belt" in the following text. The endless conveyor belt is guided around running rollers which are likewise mounted on perpendicular shafts.

In one refinement, each driving conveyor belt, that is to say each endless conveyor belt of a transport element, has projections which engage into corresponding cutouts of the retaining element which lies opposite, for example into the slot between two stationary components which lie above one another. The projections and cutouts extend in the longitudinal direction along the transport direction and are configured, for example, as horizontal continuous lines. It is also possible that the retaining element has projections which engage into cutouts of the transport element.

In the exemplary embodiment, the transport element of each separator contains a plurality of driving conveyor belts which lie above one another and engage into slots between in each case two stationary components, which lie above one another, of the corresponding retaining element, without the driving conveyor belts and stationary components coming into contact with one another. As a result, a mail item which is transported through between the transport element and the retaining element is temporarily given a contour in the form of a sinuous line, as viewed in the transport direction. The driving conveyor belts and stationary retaining components form two sawtooth lines.

In one refinement, each separator additionally contains an intake apparatus. The intake apparatus sucks in air. The air flows through cutouts in each driving conveyor belt of the transport element and generates a vacuum. The vacuum pulls an item (an individual mail item or a plurality of overlapping mail items) toward the driving conveyor belts and increases the transverse force and therefore the frictional force between each driving conveyor belt and the mail item, which frictional force acts on the mail item. It is also possible that the intake apparatus generates a vacuum between the retaining element and the mail item.

In the exemplary embodiment, a sequence of cutouts in the form of holes is made in each driving conveyor belt. The cutouts preferably extend over the entire length of a driving conveyor belt. An intake apparatus which bears against the driving conveyor belts then sucks air through the cutouts when the cutouts are guided past an intake chamber of the intake apparatus. No air is sucked in through the slot between two adjacent driving conveyor belts.

The transport rollers of the advancing elements are driven in opposite rotational directions.

The mail items are transported in an upright manner to the first separator. Each flat mail item is therefore standing on one edge. An under floor conveyor belt transports the upright mail items in a transport direction which lies parallel to the object planes or is perpendicular on the object planes.

In one refinement, a stack of flat mail items is transported perpendicularly with respect to their object planes toward the first separator. In another refinement, the mail items are transported in a direction parallel to their object planes to the first separator, a plurality of mail items partially overlapping as a rule. Here, the "overlap" is to be understood as being in a direction perpendicular with respect to the object planes of the flat mail items.

The mail items, also those which overlap, pass between the transport element and the retaining element of the first separator. The transport element of the first separator drives overlapping mail items. For example, the mail items adhere to the driving conveyor belts and are moved by the retaining element toward the first transport element.

The first separator extends overlapping mail items because the coefficient of friction between a mail item and the retaining element is greater than the coefficient of friction between two overlapping mail items. In order to bring this about, the transport element moves more quickly than the retaining element of the first separator, with the result that a relative speed of the transport element occurs relative to the retaining element. In the exemplary embodiment, the retaining element does not move at all. Preferably no slip occurs between the mail item and the transport element because the coefficient of friction and therefore the frictional force between a mail item and the transport element is even greater. The optionally generated vacuum reinforces this effect.

Each separator brings it about as a result that flat upright mail items are extended in a perpendicular extending plane. The respective object planes of the flat mail items are arranged parallel to the extending planes. In the exemplary embodiment, furthermore, each separator has an advancing element with two driven transport rollers. The two transport rollers are rotated at the same rotary speed in different rotational directions. At every contact point, the two transport rollers bring about the same transport vector. The two transport rollers have in each case one nonslip outer face and are seated on parallel and driven rollers. The advancing element is arranged downstream of the transport element and the retaining element of the separator.

In the exemplary embodiment, the transport rollers are sprung in such a way that compression springs press the two transport rollers against one another, but a mail item is capable of pressing the transport rollers apart from one another when the two transport rollers grip the mail item and advance it.

Furthermore, the first separator has the first advancing element with the two transport rollers, which first advancing element is arranged downstream of the transport element and the retaining element. A mail item is transported through between both transport rollers, both transport rollers gripping the mail item temporarily. As soon as the front edge of a mail item is gripped by the two transport rollers, the transport element and the retaining element are stopped. The transport rollers advance a mail item between the transport element and the retaining element. If the mail item overlaps partially with a following mail item, the transport rollers grip only the leading mail item, but not the following mail item. The following mail item is retained by the transport element and the retaining element. As soon as it is determined that the rear edge of the leading mail item has passed the transport rollers, at least the transport element is rotated again and transports the following mail item toward the transport rollers.

The first separator therefore operates in a start/stop mode. The transport element is continuously started and stopped again. In contrast, the transport rollers of the advancing element are rotated continuously.

A light barrier or another suitable sensor measures the events, namely that a front edge of a mail item has reached the two transport rollers of the first separator and that the rear edge has passed the transport rollers. The mail item interrupts the light beam which the transmitter of the light barrier has emitted.

An individual mail item which is transported by the transport element of the first separator drives the retaining element in rotation in one refinement. In another refinement, the retaining element remains stationary. In contrast, two overlapping mail items are extended by the interaction of the transport element and the retaining element.

The second separator preferably operates in the same way, as long as the second separator likewise operates in the separating mode.

The transport element of the second separator is preferably arranged on the other side of that transport path, over which the mail items are transported, than the transport element of the first separator. If, therefore, the transport element of the first separator is arranged to the left of the transport path as viewed in the transport direction, the transport element of the second separator is situated to the right of the transport path. Correspondingly, the retaining elements of the two separators are also attached on different sides of the transport path.

This refinement brings about improved separation. The following is namely possible: two mail items overlap partially before they reach the first separator. The leading mail item bears against the retaining element of the first separator, and the following mail item bears against the transport element of the first separator. The transport element is capable of transporting the following mail item forward relative to the leading mail item and bringing about separation as a result. However, it can occur that the following mail item which is pulled forward becomes hooked in a tab or a viewing window or a similar component of the leading mail item and cannot be advanced further, with the result that the first separator is not capable of separating these two mail items.

In this constellation, in contrast, the second separator will pull the leading mail item forward relative to the following mail item and bring about the separation as a result. The hooking between the two mail items is released automatically by virtue of the fact that the second separator introduces forces on another side of the item which contains the hooked mail items than the first separator.

FIG. 1 shows the two separators by way of example. The first separator contains the driven first transport element 10.1, which contains a plurality of driving conveyor belts which lie above one another, and the first retaining element 2. Two compression springs 28.1, 28.2 press the first retaining element 2 against the driving conveyor belts of the first transport element 10.1 to such an extent that only a predefined minimum spacing remains between the transport element 10.1 and the retaining element 2.

Furthermore, FIG. 1 shows a first advancing element 3 with the two transport rollers 3.1, 3.2 which lie downstream of the first transport element 10.1 and the first retaining element 2, a light barrier 14 with a transmitter 14.1 and a receiver 14.2, and a control device 5.

A mail item which is transported by the first transport element 10.1 is gripped by the transport rollers 3.1, 3.2 and is transported to the second separator. The light barrier 14 measures when the front edge of the mail item has reached the transport rollers 3.1, 3.2. The transmitter 14.1 preferably emits a light beam which is situated in that plane which is defined by the two center axes of the transport rollers 3.1, 3.2.

A drive motor 15 rotates the transport roller 3.1 or both transport rollers 3.1, 3.2 of the first advancing element 3. In one refinement, the transport rollers 3.1, 3.2 rotate equally as quickly as the driving conveyor belts of the first transport element 10.1.

The control device 5 actuates the drive motors for the transport elements and advancing elements of the two separators and brings about this start/stop mode as a result. The light barriers transmit signals to the control device 5, and the control device 5 processes the signals.

Furthermore, FIG. 1 shows the two extending planes AE.1, AE.2. A lateral offset V occurs between the two extending planes AE.1, AE.2. In the exemplary embodiment, the two perpendicular extending planes AE.1, AE.2 are parallel to one another, with the result that the lateral offset V remains constant over the entire extent of the extending planes AE.1, AE.2.

In the exemplary embodiment, the driving conveyor belts of the first transport element 10.1 are guided around the three rollers 30, 31 and 32. A drive motor 16 rotates the roller 32 and therefore the first transport element 10.1. The control device 5 is capable of switching both drive motors 15, 16 on and off again.

In the exemplary embodiment, the first separator contains, furthermore, an intake chamber 50. Each driving conveyor belt of the first transport element 10.1 is guided past an opening of the intake chamber 50. The intake chamber 50 sucks in air through the opening and through cutouts in the driving conveyor belts of the transport element 10.1.

Figure 2:
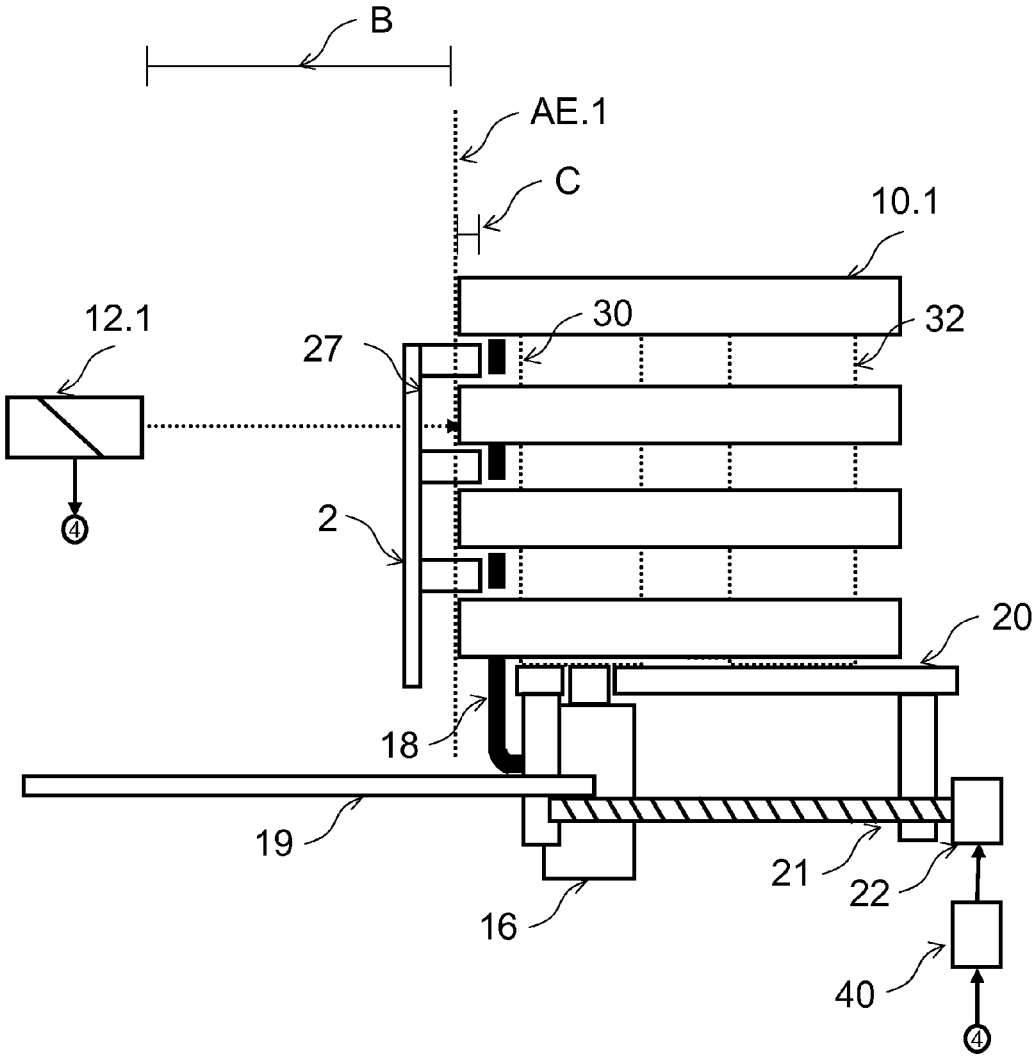
FIG. 2 is a sectional view of a first separator taken along the plane II-II shown in FIG. 1.

FIG. 2 shows in detail and in the plane II-II from FIG. 1 that the first transport element 10.1 contains a plurality of individual driving conveyor belts which lie above one another. The first retaining element 2 has a plurality of stationary components which are arranged above one another and between which the rake 27 of a belt support 18 lies. The individual components of the first retaining element 2 run over in each case one projection of the rake 27. The first retaining element 2 has projections which bear against a mail item.

The driving conveyor belts of the first transport element 10.1 protrude with a spacing C beyond the projections of the first retaining element 2. The first retaining element 2 is mounted on the separator base plate 19. In an embodiment which has already been shown, the first retaining element 2 contains a plurality of stationary components which are arranged above one another and lie on a rake 27 of a belt support 18. The belt support 18 is mounted in a stationary manner on the separator base plate 19.

The three rollers 30, 31, 32, around which the driving conveyor belts of the first transport element 10.1 are guided, are mounted on a mounting plate 20. The mounting plate 20 is preferably mounted movably in such a way that an actuating drive 22 is capable of displacing the mounting plate 20 in a displacement direction VR perpendicularly with respect to the transport direction T and perpendicularly with respect to the transport path, see FIG. 1. In contrast, the separator base plate 19 is mounted in a stationary manner. Because the mounting plate 20 can be displaced relative to the separator base plate 19, the spacing between the first transport element 10.1 and the first retaining element 2 can be changed, as a result of which wear of the first transport element 10.1 can be compensated for.

The actuating drive 22 preferably rotates at least two toothed belts, and the toothed belts rotate at least two spindles. The spindles engage into corresponding fastening elements of the mounting plate 20. A rotation of the spindles 21 causes the mounting plate 20 to perform a linear movement, to be precise perpendicularly with respect to the transport direction T, in which the first separator transports mail items. The actuating drive 22 is actuated by the control device 5 and is capable of rotating the spindles 21.

The second separator contains the following components which are shown in FIG. 1:

a driven transport element 10.2 (the second transport element) in the form of a plurality of endless conveyor belts which lie above one another, a drive motor 9 for the second transport element 10.2, a retaining element 7 (the second retaining element) in the form of a plurality of stationary components which are arranged above one another, an advancing element 8 having two driven transport rollers 8.1, 8.2, a drive motor 33 for the transport rollers 8.1, 8.2, a light barrier 11 having a transmitter 11.1 and a receiver 11.2, and an intake chamber 51.

According to the solution, the path which a mail item covers during transport between the transport element and the retaining element of the second separator, as viewed in the transport direction, is longer than a mail item of maximum length. FIG. 1 shows a mail item Ps of maximum length.

An arrangement having a plurality of compression springs 29.1, 29.2 presses the second retaining element 7 against the driven second transport element 10.2.

The two transport rollers 8.1, 8.2 of the second advancing element 8 advance the separated mail items between the second transport element 10.2 and the second retaining element 7.

In the exemplary embodiment, the transport element 10.1 of the first separator is arranged to the left of the conveying path as viewed in the transport direction T, and the transport element 10.2 of the second separator is arranged to the right of the conveying path.

In the exemplary embodiment, the second separator can be switched to and fro between two modes, namely a separating mode and a transport mode.

In the exemplary embodiment, the second separator has a light barrier 11 with a transmitter 11.1 and a receiver 11.2. The light barrier 11 determines whether the front edge of an "item" has reached the transport rollers 8.1, 8.2. The term "item" denotes both an individual mail item and a plurality of mail items which overlap partially or totally.

In the separating mode, the second separator operates in exactly the same way as the first separator in the start/stop mode. The second transport element 10.2 transports an item as far as the transport rollers 8.1, 8.2 of the second advancing element 8. As soon as the front edge of this item has reached the transport rollers 8.1, 8.2, the second transport element 10.2 is stopped. The transport rollers 8.1, 8.2 which continue to be driven advance the leading mail item between the second transport element 10.2 and the second retaining element 7. The second transport element 10.2 and the second retaining element 7 retain a following mail item. As a result, overlapping mail items are extended and separated from one another.

In the transport mode, the second separator transports a mail item without being stopped and without exerting a separating action. The second transport element 10.2 therefore transports an item further even if its front edge has reached the transport rollers 8.1, 8.2.

The second separator is operated in the transport mode until it is determined that the first separator has not completely separated two overlapping mail items. Only then is the second separator switched over into the separating mode and separates the overlapping mail items. As soon as all of these separated mail items have completely left the second separator, the second separator is switched over again into the transport mode.

The second separator is then switched over from the transport mode into the separating mode if it is determined that an item in the second separator contains a plurality of overlapping mail items, and the front edge of the item, that is to say the front edge of the front most mail item, has reached the transport rollers 8.1, 8.2. This reaching of the transport rollers 8.1, 8.2 is determined by the light barrier 11. The second separator is preferably changed over precisely when the transport rollers 8.1, 8.2 are reached. The front most mail item is transported further to such an extent that the transport rollers 8.1, 8.2 grip the front most mail item reliably.

The second separator is switched over from the transport mode into the separating mode by virtue of the fact that the control device 5 stops the drive motor 9 of the second transport element 10.2. The transport rollers 8.1, 8.2 then advance the leading mail item between the second transport element 10.2 and the second retaining element 7 which are both stopped. The following mail item is retained by the second transport element 10.2 and by the second retaining element 7.

It is preferably prevented that further mail items are transported into the second separator, as long as the second separator eliminates the detected double draw-off. This is prevented by the entire first separator additionally being stopped temporarily. The control device 5 therefore stops the drive motors 16 (for the first transport element 10.1) and 15 (for the first advancing element 3). The stopping of the first separator is preferably carried out at the same time as the step of switching over the second separator into the separating mode. Only when all the previously overlapping mail items have completely left the second separator does the control device 5 restart the first separator. The control device 5 preferably switches over the second separator again into the transport mode at the same time.

A light barrier determines that instant, at which the rear edge of the leading mail item which has now been separated has passed the light barrier and therefore a gap occurs between the leading and the now following mail item. The light barrier can be the light barrier 1 or a light barrier of the light barrier arrangement 4 described further below or a further light barrier which is arranged downstream of the light barrier 14. Discovering the gap triggers the steps of the control device 5 switching over the second separator again into the transport mode and switching on the drive motor 9 again. The second transport element 10.2 transports mail items continuously to the transport rollers 8.1, 8.2. Moreover, the first separator starts up its start/stop mode again. For this purpose, the control device 5 restarts the drive motors 16 (for the first transport element 10.1) and 15 (for the first advancing element 3).

The second separator therefore operates in the start/stop mode only when a double draw-off is determined, and otherwise operates in a continuous transport mode. As a result, a considerably higher throughput is achieved. Moreover, the wear-susceptible start/stop mode is reduced to the required minimum.

In order to decide automatically whether an item in the second separator is an individual mail item or contains a plurality of partially overlapping mail items, the apparatus contains, furthermore, a light barrier arrangement 4. The light barrier arrangement 4 has a transmitter line 4.1 with a plurality of transmitters and a receiver line 4.2 with a plurality of receivers which are arranged behind one another.

In one refinement, the transmitter line 4.1 and the receiver line 4.2 extend over the length of the entire first separator and the entire second separator. In the minimum refinement, the light barrier arrangement 4 monitors at least the second transport element 10.2 and the second retaining element 7.

The transmitter line 4.1 contains at least one row with a multiplicity of transmitters which emit parallel light beams. Correspondingly, the receiver line 4.2 contains at least one row with a multiplicity of receivers which receive the light beams from the transmitters. It is possible that the transmitter line 4.1 and the receiver line 4.2 in each case contain a plurality of individual lines which are arranged above one another. As a result, the light barrier arrangement 4 is capable of detecting different mail items of different heights.

Each mail item interrupts each light beam from a transmitter if the light beam strikes the mail item. A light beam from a transmitter, which light beam is not interrupted by a mail item, strikes the corresponding receiver.

A sequence of measuring instants is predefined. The temporal interval between two measuring instants which follow one another is varied, for example, in an inversely proportional manner to the transport speed of the second separator, or remains constant. The temporal interval is so small that a plurality of measuring instants fall within each time period, in which a mail item runs through the second separator.

At every measuring instant, each receiver of the receiver line 4.2 supplies precisely one of the two possible signals "light beam has struck receiver" or "no light beam has struck", that is to say light beam interrupted by a mail item. As a result, a sequence of items in the second separator is discovered for each measuring instant, an item containing an individual mail item or a plurality of at least partially overlapping mail items. In each case one gap, through which at least one light beam passes, is situated between in each case two items which follow one another.

Each item interrupts at least one light beam. The spacing between two gaps which follow one another is equal to the length of the transported item between the two gaps. This gap spacing is calculated approximately as the spacing between the two receivers of the receiver line 4.2 which are struck by in each case one light beam.

The receiver line 4.2 transmits measured signals to the control device 5. The control device 5 evaluates the measured signals and decides whether an item which contains a plurality of overlapping mail items is transported in the second separator or not.

While an item which contains a plurality of mail items is transported through the second separator, an additional gap can occur in the item, namely because two previously overlapping mail items of the item are extended by an interaction of the second transport element 10.2 and the second retaining element 7. This extension is brought about by the second transport element 10.2 and the second retaining element 7 being actuated in such a way that a relative speed occurs between the elements 10.2 and 7 and the second transport element 10.2 is moved more quickly than the second retaining element 7.

The light barrier arrangement 4 therefore measures the length of the same item at at least two measuring instants, while the second separator is situated in the transport mode and the second transport element 10.2 transports the item toward the transport rollers 8.1, 8.2 of the second advancing element 8.

A relative speed preferably occurs between the second transport element 10.2 and the second retaining element 7. For example, the second retaining element 7 is not driven, but rather is driven in rotation by mail items, or contains stationary components. As a result, a plurality of overlapping mail items are extended, and an item which contains a plurality of mail items changes its length, while it is transported through the second separator. If the length of the item varies during the transport, the item contains a plurality of overlapping mail items.

In this case, the second separator is switched over into the separation mode, as soon as the front edge of the item reaches the light barrier 11. The front edge is formed by the front edge of the leading mail item of the item. The retaining element 7 and the transport element 10.2 of the second separator retain every following mail item of the item.

Instead of a light barrier arrangement 4, the second separator can also have a camera which produces a side image of the item. The contour of the item in the image is evaluated. If the contour exhibits a plurality of rectangles, the item contains a plurality of mail items. This refinement spares the necessity to generate a relative speed between the second transport element 10.2 and the second retaining element 7.

The transport path which is run through by the mail items preferably contains two straight sections and a curved transition region. The first straight section is formed by the first transport element 10.1 and the first retaining element 2 of the first separator, and the second straight section is formed by the second transport element 10.2 and the second retaining element 7 of the second separator. The second straight section is offset laterally relative to the first section, with the result that the transition region is curved, to be precise is preferably curved in an S-shape. FIG. 1 shows this lateral offset V in exaggerated form.

The first separator is capable of extending objects in a first extending plane. The second separator is capable of extending objects in a second extending plane. In the exemplary embodiment, the two extending planes are arranged parallel to one another and are at a spacing V from one another. An element 7.1 acts as diverting element. If an object is transported from the first separator to the second separator, the diverting element 7.1 diverts the object from the first into the second extending plane. The diverting element 7.1 preferably contains a plurality of diverting components which lie above one another, here the curved components of the second retaining element 7.

In one modification, the two extending planes meet one another at an acute angle. As a result, the two extending planes intersect in a straight line. If a mail item is transported from the first separator to the second separator, the mail item is rotated about a rotational axis which lies parallel to the line of intersection. This rotation often additionally improves the separating action.

If two overlapping mail items run through the curved region, the front edge of the leading mail items is already gripped by the downstream second separator and the rear edge of the following mail item is still gripped by the upstream first separator. As a result, the spacings between the front edges and/or the rear edges can change, and a spacing and/or an offset occur/occurs between the two mail items. This brings about a situation where the mail items are separated more easily by the second separator.

In one preferred refinement, the wear of the driving conveyor belts of the transport elements 10.1, 10.2 and/or of the retaining elements 2, 7 is monitored, and at least one element is adjusted automatically. FIGS. 1 to 4 illustrate this adjustment by way of example for the first transport element 10.1 of the first separator.

A distance sensor 12.1, 12.2, 12.3 continuously measures the spacing between itself and that surface of the first driving conveyor belt 10.1 which faces the mail items to be separated. The separating of mail items leads to particles being abraded from the facing surface of the conveyor belt 10.1 and, as a result, the spacing between the first transport element 10.1 and the first retaining element 7 being reduced. Correspondingly, the section C is reduced, by which the first transport element 10.1 protrudes out of the retaining element 2.

In order to compensate for this increase in spacing, the mounting plate 20 is displaced by way of the first transport element 10.1 transversely with respect to the transport direction in the displacement direction VR toward the first retaining element 2. As a result, the spacing between the first transport element 10.1 and the first retaining element 2 is changed. The actuating drive 22 rotates the spindles 21, with the result that a desired transmission ratio is brought about between the rotation of the actuating drive 22 and the displacement of the mounting plate 20. A regulator 40 actuates the actuating drive 22. Signals are transmitted from a distance sensor to the regulator 40. The regulator 40 uses these measured signals and a setpoint variable in order to calculate the actuating commands to the actuating drive 22.

In one refinement which is shown by FIG. 2, a distance sensor 12.1 measures the spacing B between itself and that surface of the driving conveyor belts of the first transport element 10.1 which faces the first retaining element 2 and therefore the mail items to be separated. For example, the distance sensor 12.1 transmits a laser beam through a cutout in the first retaining element 2 perpendicularly onto the surface of the first transport element 10.1. The wear of the driving conveyor belts of the first transport element 10.1 increases the spacing B. In order to compensate for this increase in spacing, the mounting plate 20 is moved downward in FIG. 1 and to the left in FIG. 2 toward the first retaining element 2 and therefore toward the distance sensor 12.1.

In the refinement which is shown in FIG. 2, a distance sensor 12.1 therefore measures the spacing B directly. The mounting plate 20 is displaced such that the spacing remains constant.

One problem of this refinement is that a spacing measurement is made more difficult or is even impossible if a mail item is situated between the first transport element 10.1 and the first retaining element 2.

In an alternative refinement, it is made possible to permanently measure a dimension for the wear of the first driving conveyor belt 10.1, even if a mail item between the first driving conveyor belt 10.1 and the first retaining element 2 prevents a direct measurement of the spacing B. For this purpose, a spacing sensor 12.2 is used. For example, the spacing sensor 12.2 measures the spacing D between the surface of the first driving conveyor belt 10.1 and the distance sensor 12.2, to be precise in a region, in which the first driving conveyor belts of the first transport element 10.1 are guided around the roller 32 and which region does not lie opposite the first retaining element 2.

Figure 3:
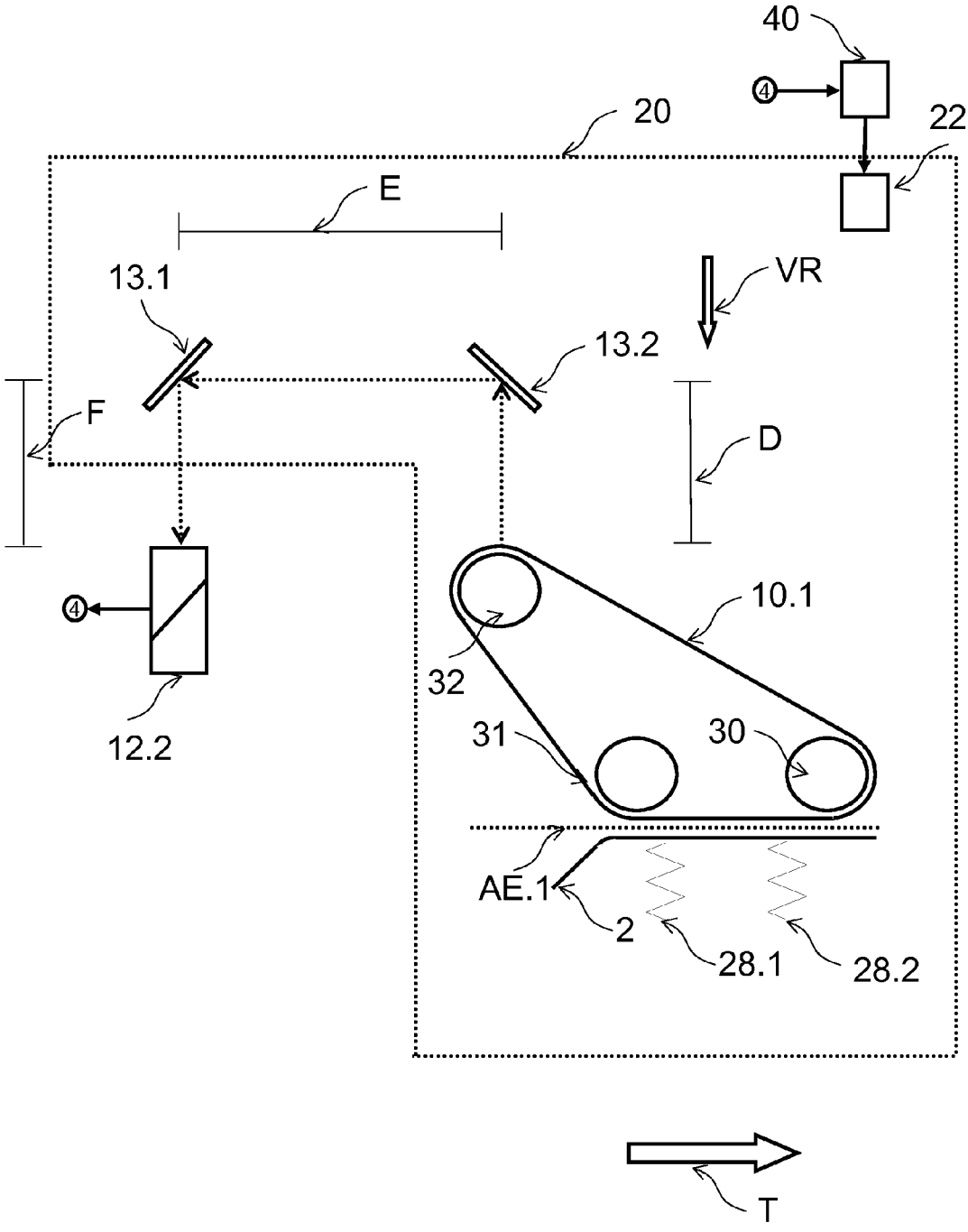
FIG. 3 is an illustration of the first separator of the apparatus from FIG. 1 in a detailed view with a measuring arrangement.

FIG. 3 shows one preferred embodiment which makes permanent measurement and simple regulation possible. In this embodiment, two passive reflectors 13.1, 13.2 are used. The constant spacing E occurs between the two passive reflectors 13.1, 13.2, and the spacing F occurs between the distance sensor 12.2 and the passive reflector 13.1. The spacing F changes if the mounting plate 20 is displaced. If the mounting plate 20 is displaced in the displacement direction VR, the spacing F is reduced. The spacing D which is increased by the wear of the driving conveyor belts of the first transport element 10.1 is produced between the passive reflector 13.2 and the surface of the first driving conveyor belt 10.1. The distance sensor 12.2 measures the overall spacing D+E+F. The distance sensor 12.2 preferably supplies a voltage value which depends on the measured spacing.

The distance sensor 12.2 is mounted in a stationary manner. The first transport element 10.1 and the two passive reflectors 13.1, 13.2 are mounted on the mounting plate 20 and can be displaced relative to the distance sensor 12.2 as a result. The wear of the first transport element 10.1 increases the spacing D. A displacement of the mounting plate 20 in the displacement direction VR brings it about that the spacing F is reduced. The mounting plate 20 is displaced in such a way that the overall spacing D+E+F remains constant. This brings it about that the displacement of the mounting plate 20 just compensates for the wear of the first transport element 10.1.

In contrast, the wear of the surface of the first retaining element 2 is preferably compensated for automatically by the first retaining conveyor belt 2 being pressed against the belt support 18.

Figure 4:
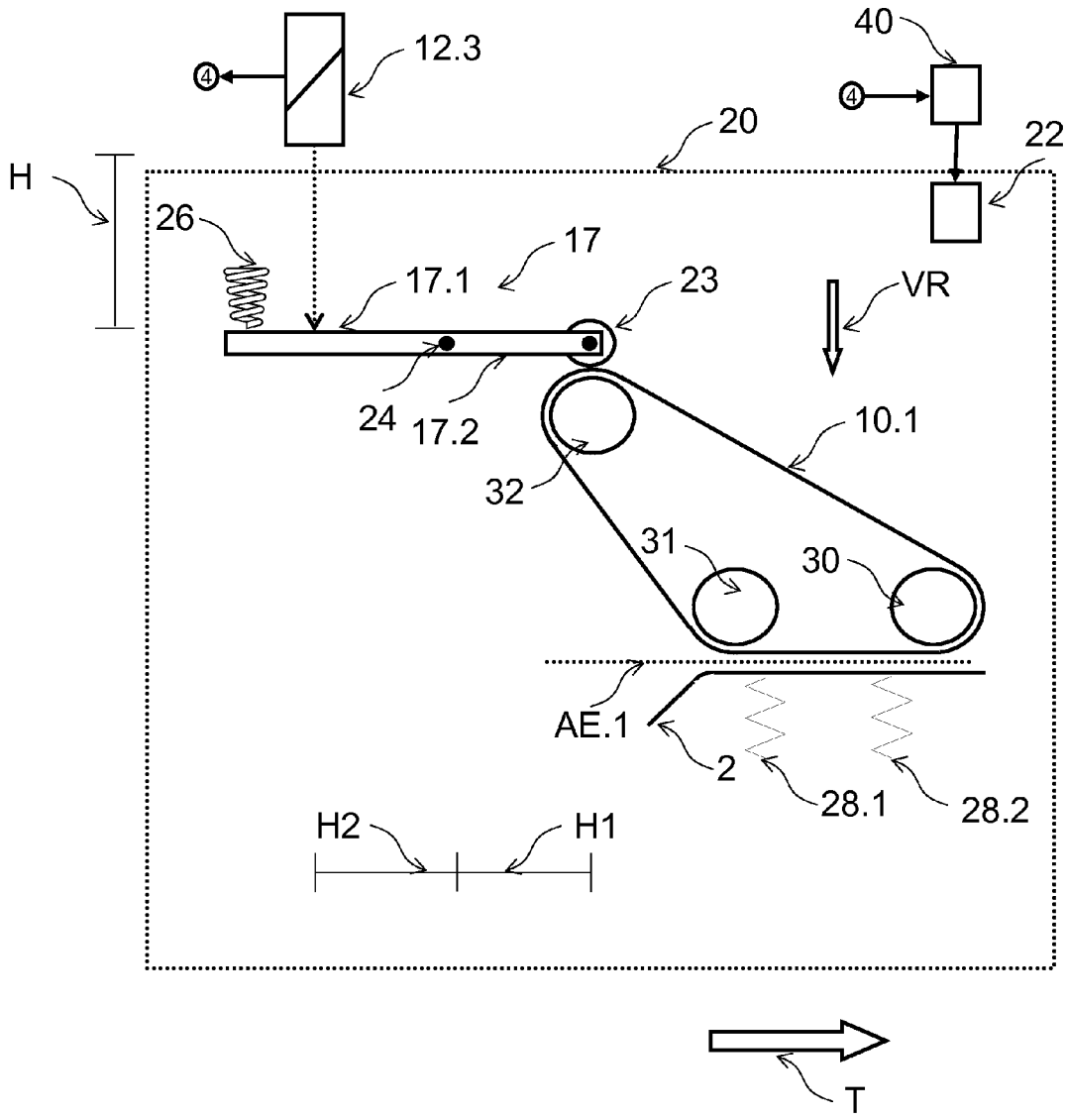
FIG. 4 is an illustration of the detailed view from FIG. 3 with a measuring arrangement which has a measurement lever.

FIG. 4 shows a third refinement for monitoring and adjusting the first transport element 10.1. This refinement measures a spacing by means of at least one measurement lever 17. In this third refinement, at least one measurement lever 17 is pressed against the surface of a driving conveyor belt of the first transport element 10.1, to be precise in the region of the roller 32 and therefore in turn outside a region, in which a mail item is situated. It is possible that a plurality of measurement levers which are arranged above one another are pressed against in each case one driving conveyor belt.

A running roller 23 or a rotatably mounted ball 23 is in constant contact with the surface of the driving conveyor belt. For example, this constant contact is brought about by the measurement lever 17 being mounted rotatably on an axle 24 and a tension spring 26 pulling the free arm 17.1 of the measurement lever 17 to itself. The roller or ball 23 is seated at the end of the other arm 17.2 of the measurement lever 17. A distance sensor 12.3 measures the spacing H between itself and a point of the free arm 17.1 of the measurement lever 17. A reflecting foil or a similar element can be mounted on a surface of the free arm 17.1 of the measurement lever 17, which simplifies the distance measurement. The distance sensor 12.3 is mounted in a stationary manner, with the result that the first transport element 10.1 which is mounted on the mounting plate 20 can be displaced relative to the distance sensor 12.3. The surface of the transport element 10.1 can therefore be optimized for the separation by extension, and the surface of the measurement lever 17 can be optimized for the measurement of the section length.

The wear of a driving conveyor belt of the first transport element 10.1 brings it about that the measurement lever 17 is rotated about the axle 24 and the spacing H between the free arm 17.1 and the distance sensor 12.3 changes as a result. In the example of FIG. 4, the measurement lever 17 is rotated in the clockwise direction by the wear, and the measured spacing H is reduced. The reduction of the spacing H is proportional to the wear of the driving conveyor belt of the first transport element 10.1. The proportionality factor H1:H2 can be fixed by suitable positioning of the sensor 12.2 relative to the free arm 17.1. Here, H1 is the spacing between the contact point of the running roller 23 with the first transport element 10.1 and the shaft 24. H2 is the spacing between the space point of the distance sensor 12.3 and the shaft 24.

It is preferable that H1=H2, with the result that simple regulation is made possible. The mounting plate 20 is displaced in the displacement direction VR in such a way that the measured spacing H always remains the same.

In the embodiment which has just been described, the first transport element 10.1 is mounted onto a displaceable mounting plate 20, and the first retaining element 2 is mounted in a stationary manner. This refinement has the advantage that a mail item which is transported by the transport element and bears against the retaining element is always in contact with the advancing device in the gap between the two transport rollers 3.1, 3.2.

In an alternative embodiment, the first retaining element 2 is mounted on the displaceable mounting plate 20, and the first transport element 10.1 is mounted on a stationary base plate 19. In this alternative embodiment, the wear of the first transport element 10.1 is also measured, to be precise as described above with a distance sensor 12.1, 12.2, 12.3. The regulator 40 actuates the actuating drive 22, and the actuating drive 22 displaces the mounting plate 20 with the first retaining element 2 in such a way that the spacing between the first retaining element 2 and the first transport element 10.1 is reduced. In this way, the wear of the first transport element 10.1 is also compensated for.

The refinement of mounting the stationary retaining element 2 onto the displaceable mounting plate 20 makes a mechanically simple construction possible, because no driven parts are mounted on the mounting plate 20. However, the advancing element 3 has to be adjusted, or a mail item will not enter the gap between the two transport rollers 3.1, 3.2 precisely.

The invention claimed is:

1. An apparatus for separating flat objects each extending in an object plane, the apparatus comprising:

a first separator;

a second separator;

an overlap detection device;

a control device;

each of said first and second separators being configured for extending a plurality of the flat objects, which overlap at least partially, in in each case a direction parallel to object planes and for separating them as a result;

the apparatus transporting a flat object from said first separator to said second separator;

said overlap detection device checking automatically whether the flat object which is transported by said second separator contains a single flat object or a plurality of overlapping flat objects;

said control device being configured, when said overlap detection device has detected that a transported item contains a plurality of overlapping flat objects, to switchover said second separator into a separation mode, in which said second separator separates the overlapping flat objects, and said second separator able to operated in a transport mode, in which said second separator transports the flat objects;

said second separator containing a transport element, a retaining element and a drive for said transport element;

the apparatus transporting the flat objects to be separated through between said transport element and said retaining element of said second separator;

said drive driving said transport element such that said transport element is moved relative to said retaining element and, as a result, extending of at least partially overlapping flat objects is brought about;

said transport element and said retaining element are configured such that a path which the flat object covers between said transport element and said retaining element is longer than a greatest extent of the flat object in a transport direction; and said overlap detection device is configured for measuring, at at least two instants, a respective length of a same one item which is transported through between said transport element and said retaining element of said second separator, and, when at least two lengths which are measured for a same item differ from one another, deciding automatically that the item contains a plurality of overlapping flat objects.

2. The apparatus according claim 1, wherein said overlap detection device has a transmitter line with a plurality of transmitters and a receiver line with a plurality of receivers, each of said transmitters of said transmitter line is configured for emitting a light beam which either strikes at least one of said receivers of said receiver line or is interrupted by the flat object which is transported in said second separator, each of said receivers of said receiver line is configured for measuring whether the light beam strikes said receiver or not.

3. The apparatus according to claim 1, wherein said control device is configured for stopping said drive for said transport element as a part step during the switchover of said second separator into the separating mode.

4. The apparatus according to claim 1, wherein:

said second separator contains a position sensor and an advancing element, said advancing element is configured for gripping the flat object temporarily and transporting it, said position sensor detects whether the flat object has been gripped by said advancing element or not; and said control device is configured for stopping said drive for said transport element as a reaction to an event that said position sensor has detected gripping of the flat object, and for concluding the switchover of said second separator into the separating mode as a result.

5. The apparatus according to claim 1, wherein:

said first separator further contains a transport element and a retaining element;

the apparatus is configured for transporting the flat object along a transport track in a transport direction, the transport track extending through between said transport element and said retaining element of said first separator and between said transport element and said retaining element of said second separator; and said transport element of said first separator being arranged on a different side of the transport track than said transport element of said second separator.

6. The apparatus according to claim 1, wherein:

said transport element of said second separator contains a driven endless conveyor belt;

said drive is configured for rotating said driven endless conveyor belt; and said control device is configured for stopping said drive and therefore said driven endless conveyor belt during the switchover of said second separator from the transport mode into the separating mode, and for activating said drive and therefore for triggering a transport movement of said driven endless conveyor belt during the switchover of said second separator from the separating mode into the transport mode.

7. The apparatus according to claim 1, wherein:

said first and second separators are each configured to extend and as a result separate a plurality of the flat objects, which overlap at least partially, in in each case one extending plane parallel to the object planes; and said first and second separators are disposed such that a lateral offset occurs between said first and second separators, with a result that a spacing occurs between the two extending planes.

8. The apparatus according to claim 1, further comprising a position sensor for detecting that a front edge, as viewed in a transport direction, of the item which is transported by said second separator has reached a position downstream of the second separator; and wherein said control device is configured for, when said position sensor has detected that the item which is transported in said second separator contains a plurality of objects, switching over said second separator into the separating mode at or after that instant, at which said position sensor has detected that a front edge of a transported item has reached the position.

9. The apparatus according to claim 1, wherein said control device is additionally configured for stopping said first separator, as soon as said control device switches over said second separator into the separating mode.

10. A method for separating flat objects extending in an object plane, which comprises the steps of:

providing a first separator and a second separator, each of the separators extending a plurality of the flat objects, which overlap at least partially, in in each case one direction parallel to object planes and separates them as a result, the second separator having a transport element and a retaining element;

running a flat object first of all through the first separator;

transporting the flat object to the second separator and then running the flat object through the second separator by the further steps of:

transporting the flat objects to be separated through between the transport element and the retaining element of the second separator;

when the second separator is in a separating mode, driving the transport element such that the transport element is moved relative to the retaining element and, as a result, an extension of at least partially overlapping flat objects is brought about, each of the flat objects is transported through over a path between the transport element and the retaining element of the second separator, the path being longer than the greatest extent of the flat object to be separated in the transport direction;

carrying out automatically a check as to whether an item which is transported by the second separator contains a single flat object or a plurality of overlapping flat objects, the checking step containing the further steps of:

measuring a respective length of a same one item which is transported by the second separator which is in the transport mode at at least two instants, and, when at least two lengths differ from one another which have been measured for the same item which is transported by the second separator, a decision is made automatically that the item contains a plurality of overlapping objects;

when it has been detected automatically that a transported item contains a plurality of at least partially overlapping flat objects, switching over the second separator to the separating mode, in which the second separator separates overlapping objects; and switching over the second separator over into a transport mode, in which the second separator transports the flat objects, after the separating of the flat objects.

11. The method according to claim 10, which further comprises stopping the transport element during the switchover of the second separator into the separating mode.

* * * * *